US005123401A

United States Patent [19]

Lange

[11] Patent Number: 5,123,401

[45] Date of Patent: Jun. 23, 1992

[54] COMBUSTION HEATING APPARATUS

[75] Inventor: Jack Lange, Winnipeg, Canada

[73] Assignee: ICG Propane Inc., Manitoba, Canada

[21] Appl. No.: 586,250

[22] Filed: Sep. 21, 1990

[30] Foreign Application Priority Data

Sep. 27, 1989 [CA] Canada ..... 613,668

[51] Int. Cl.[5] ..... F24H 1/00

[52] U.S. Cl. ..... 126/364; 126/360 R; 431/242; 431/243; 431/167; 431/351

[58] Field of Search ..... 431/242, 243, 167, 351; 126/343.5 R, 343.5 A, 364, 360 R

[56] References Cited

U.S. PATENT DOCUMENTS

| | | | |
|---|---|---|---|
| 2,431,772 | 12/1947 | Russell | 126/110 |
| 2,495,673 | 1/1950 | Erwin | 126/343.5 A |
| 2,563,683 | 8/1951 | Lewis | 431/167 |
| 3,194,215 | 7/1965 | Barnes | 431/167 |
| 3,758,764 | 9/1973 | Reichmann | 431/243 |
| 4,698,948 | 10/1987 | Yamashita et al. | 110/336 |

*Primary Examiner*—Carroll B. Dority
*Attorney, Agent, or Firm*—Adrian D. Battison; Stanley G. Ade; Murray E. Thrift

[57] ABSTRACT

A combustion heating device for use for example with oil processing equipment defines a combustion chamber within which combustion wholly takes place. The combustion chamber consists solely of a sleeve and end plate defining a vertical cylinder and a layer of ceramic fiber insulating material inside the sleeve defining the inner surface of the combustion chamber. A burner is mounted in a bottom plate of the device which can be pivoted to an open position exposing the burner for service. Air channels are defined on the outside of the sleeve so that incoming combustion air passes over the sleeve and acts as a heat recovery for any heat escaping from the insulating material. An outlet duct at an upper end of the combustion chamber at right angles to the combustion chamber extracts the combustion gases so that all heat exchange takes place outside of the combustion chamber. The device improves heating efficiency and reduces corrosion of heat transfer surfaces.

7 Claims, 4 Drawing Sheets

COMBUSTION HEATING APPARATUS

BACKGROUND OF THE INVENTION

This invention relates to a combustion heating apparatus of a type which is designed to maximize or improve the efficiency of heat transfer.

In the field of oil processing, many steps require heat to be applied to the liquid materials to reduce viscosity or to enable separation into the various components. In many cases the heat is applied to the liquid materials by using a simple elongate pipe which extends through the materials generally in a horizontal direction either as a single horizontal length of pipe or including a number of turns thus forming parallel lengths of pipe subsequently leading to a flue. Heat is generated by injecting a stream of propane into the pipe together with a quantity of air so that the propane burns in the air and generates heated combustion products. The heated gases thus pass through the pipe to the flue and as they pass through the pipe they transfer heat through the surface of the pipe to the liquid in the container surrounding the pipe.

In many cases the burner is arranged directly at one end of the pipe and injects a stream of gas into the pipe in a horizontal direction so that combustion takes place within the pipe. This has two significant disadvantages. Firstly a portion of the pipe is taken up by an initial combustion stage which generates little heat, and hence is unavailable for heat transfer. Secondly the flame tends to rise in the pipe so that it links along the upper wall of that portion of the pipe. This leads to significant corrosion in the pipe causing early failure. In addition this asymmetry of the flame within the pipe reduces the efficiency of combustion since it limits the access of the combustion air to one side of the flame. It is in most cases necessary therefore to increase the excess combustion air injected to an amount of the order of 75 percent above theoretically perfect combustion. This excess air thus reduces the temperature of combustion and increases heat losses since more of the heat is carried through the flue for escape into the atmosphere.

The above inefficiencies thus significantly increase the amount of fuel consumed in the heating process with the attendant increase in costs.

SUMMARY OF THE INVENTION

It is one object of the present invention, therefore, to provide an improved combustion heating apparatus which enables a significant improvement in heating efficiency so as to reduce or minimize fuel usage.

According to a first aspect of the invention, therefore, there is provided a combustion heating apparatus comprising a gas burner for generating a stream of gas from a supply, means defining a substantially closed combustion chamber within which combustion of the stream of gas takes place, means for supplying combustion air for entrainment with the gas stream for combustion, means insulating the chamber so as to substantially prevent escape of heat therefrom and an outlet duct arranged for extraction of the heated gases from the chamber and arranged such that substantially the whole of the heat generated by the combustion in the chamber is extracted into the outlet duct for subsequent heat transfer to a medium to be heated.

According to a second aspect of the invention, therefore, there is provided a combustion heating apparatus comprising a gas burner for generating a stream of gas from a supply, means defining a substantially closed combustion chamber within which combustion of the stream of gas takes place, means for supplying combustion air for entrainment with the gas stream for combustion, means insulating the chamber so as to substantially reduce heat escape therefrom and an outlet duct arranged for extraction of the heated gases from the chamber the insulating means comprising a layer of an insulating material defining sides and an end face for the chamber and wherein there is provided means defining an air inlet channel means surrounding at least one side of the chamber and arranged such that said combustion air is drawn into the chamber through said channel means.

According to a third aspect of the invention, therefore, there is provided a combustion heating apparatus comprising a gas burner for generating a stream of gas from a supply, means defining a substantially closed combustion chamber within which combustion of the stream of gas takes place, means for supplying combustion air for entrainment with the gas stream for combustion, means insulating the chamber so as to reduce escape of heat therefrom and an outlet duct arranged for extraction of the heated gases from the chamber, the combustion chamber comprising an elongate cylindrical body with an axis of the body arranged vertically and wherein the burner is arranged at a bottom of the cylindrical body and arranged to direct the stream of gas axially along the body, wherein the outlet duct is arranged at an upper end of the chamber substantially at right angles to the chamber.

With the foregoing in view, and other advantages as will become apparent to those skilled in the art to which this invention relates as this specification proceeds, the invention is herein described by reference to the accompanying drawings forming a part hereof, which includes a description of the best mode known to the applicant and of the preferred typical embodiment of the principles of the present invention, in which:

DESCRIPTION OF THE DRAWINGS

In the drawings like characters of reference indicate corresponding parts in the different figures.

DETAILED DESCRIPTION

Figure 4:
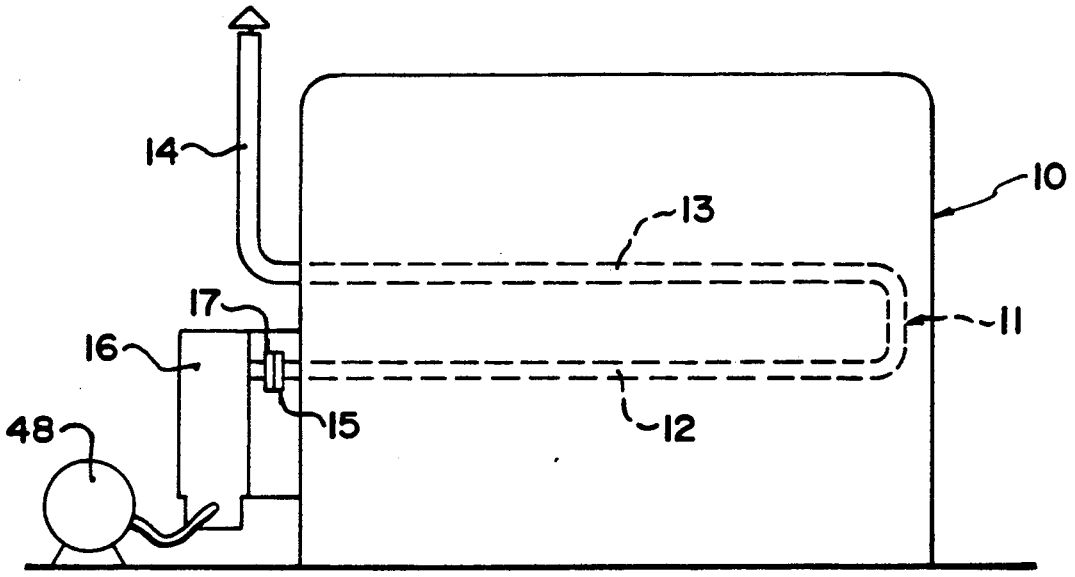
FIG. 4 is a side elevational view of a heavy oil storage tank showing a heating system using the combustion heating apparatus of FIG. 1.

Turning firstly to FIG. 4 there is shown a heavy oil storage tank 10 having a peripheral wall 10A which is illustrated here as one example of an arrangement in which the apparatus of the present invention can be used. The heavy oil storage tank is of the type which receives the oil from the underground source which contains sand or other solid material together with water from the underground location and also the heating water which is used to extract the oil from the underground source. In the tank therefore the mixture of solids, oil and water is allowed to settle so that the oils rises to an upper level for extraction and transportation to a remote processing plant. In order to maintain a required viscosity for the oil within the tank during cold weather so that it can be extracted for transportation and in order that the proper settlement can occur, a heating duct 11 is provided within the tank which includes a first horizontal pipe portion 12 and a second horizontal pipe portion 13 parallel to the first. At the end of the second portion 13, the pipe emerges from the side of the tank and connects to a flue 14 for release of the combustion products. The inlet end of the portion 12 includes an end flange 15 to which is conventionally attached a burner which injects a gas stream into the pipe portion 12 in the horizontal direction.

In the present invention, the conventional burner is removed and is replaced by a combustion heating apparatus generally indicated at 16 which includes an outlet flange 17 for direct connection to the end flange 15 of the pipe portion 12 so that combustion gases from the combustion apparatus 16 can be injected into the heating pipe 11 for transfer of heat from the combustion gases through the pipe wall into the liquid within the tank 10.

Figure 1:
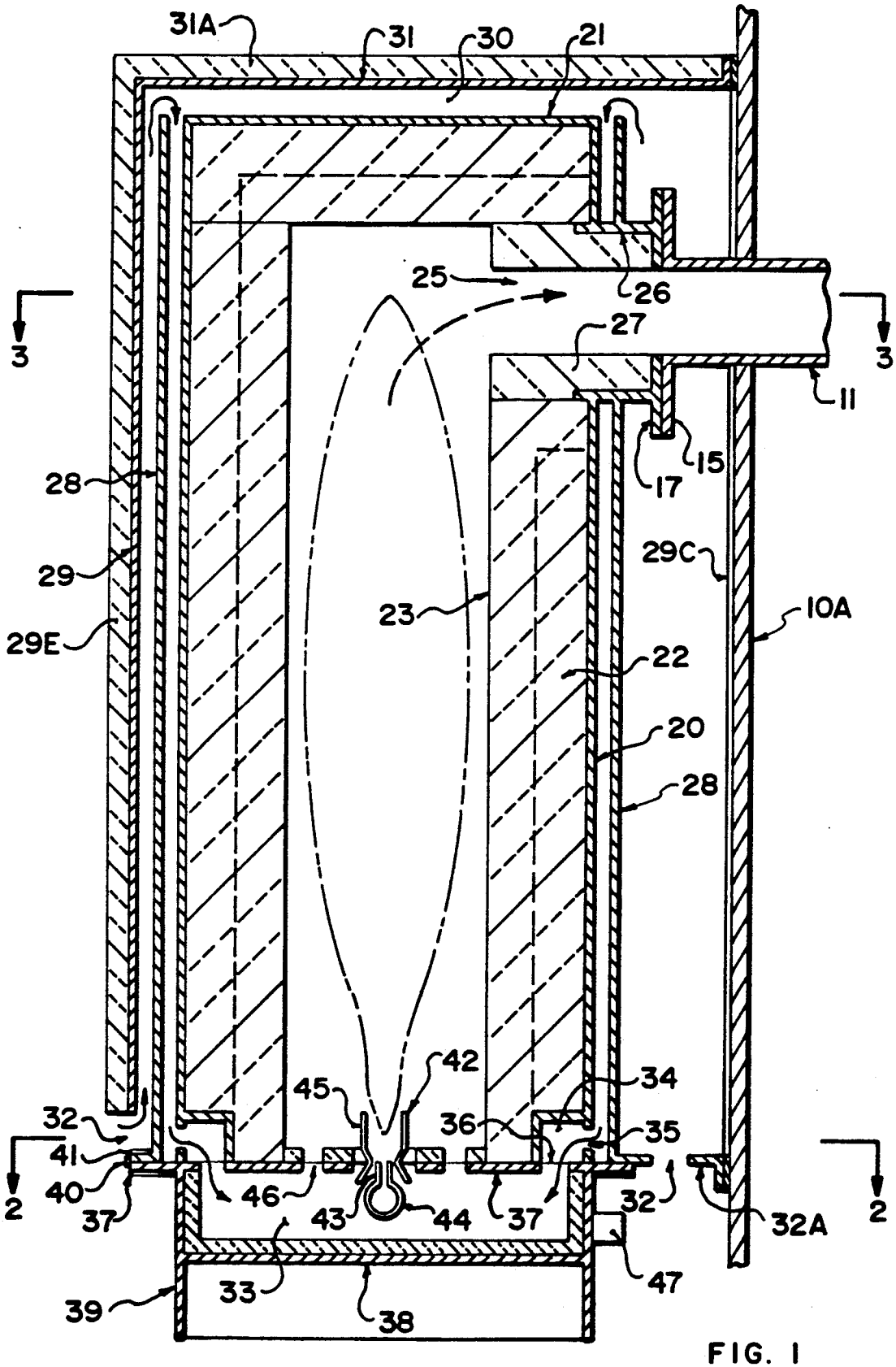
FIG. 1 is a longitudinal cross-sectional view through a combustion heating device for attachment to a heat transfer duct.
Figure 2:
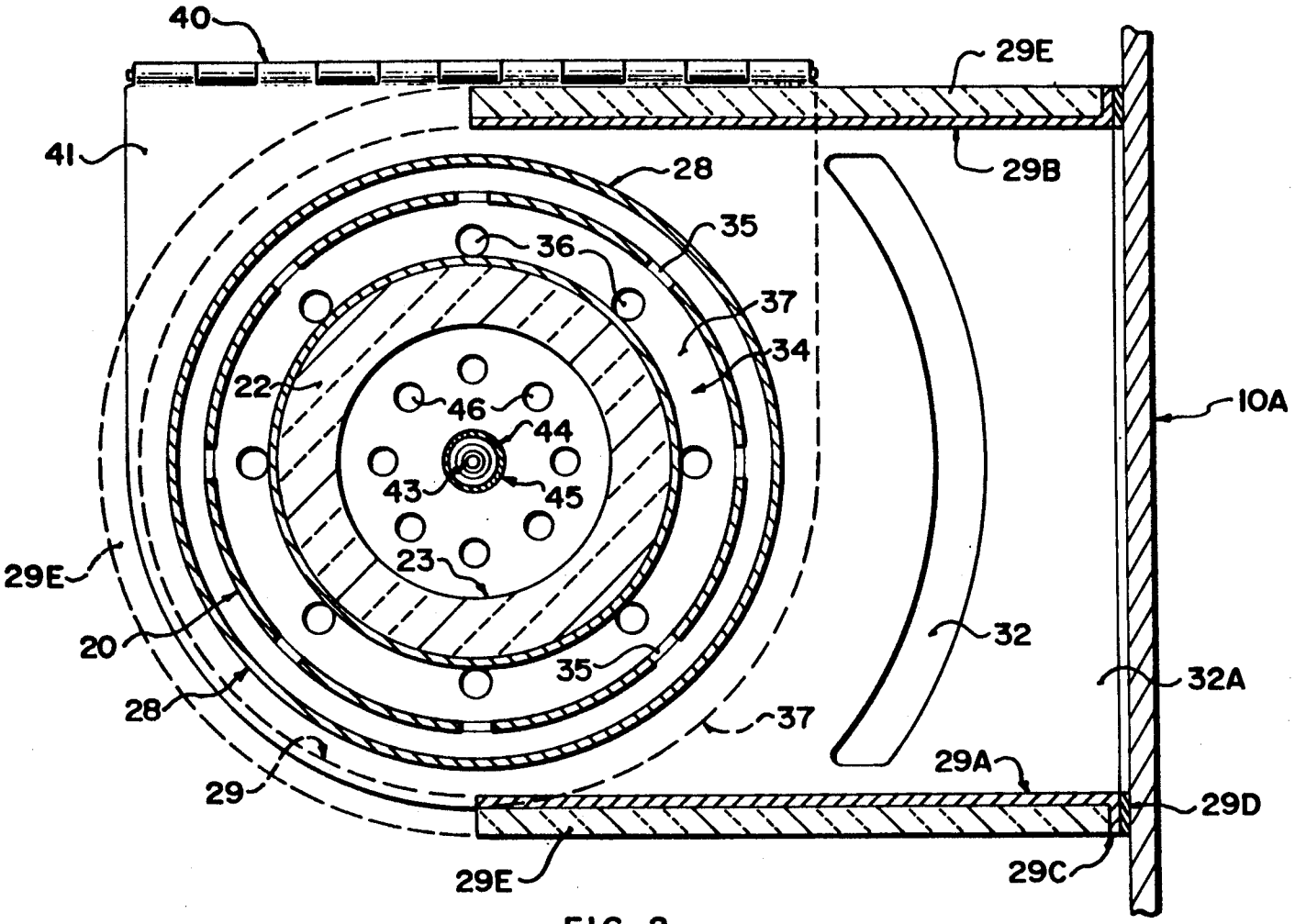
FIG. 2 is a cross-sectional view along the lines 2—2 of FIG. 1.
Figure 3:
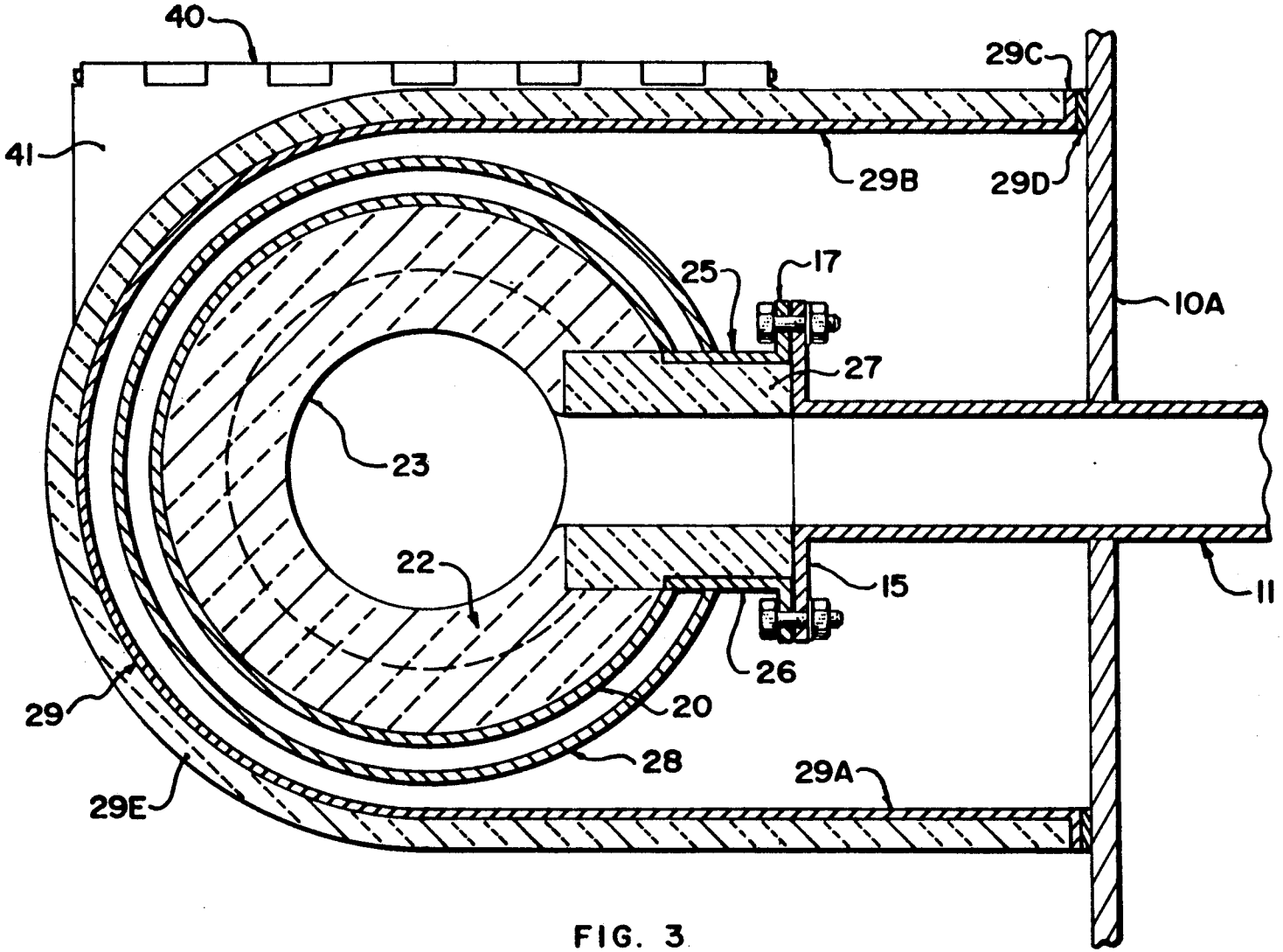
FIG. 3 is a cross-sectional view along the lines 3—3 of FIG. 1.

Turning therefore to the details of the combustion device shown in FIG. 1, 2 and 3, the device comprises a cylindrical metal container 20 which includes a circular cylindrical peripheral wall and an upper end plate 21 welded to the wall 20. A lower end of the metal cylinder or sleeve is open. Inside the sleeve both on the peripheral wall and the end wall 21 is provided a layer 22 of a fibrous insulating material. The fibrous insulating material has a thickness in one example of the order of six inches with at least the innermost part of the fibrous material being formed from a ceramic fiber mat. The mat thus defines an inner cylindrical wall 23 which forms or defines the surface of the combustion chamber within which the combustion takes place. In one example the insulating fiber layer is formed by a three inch inner layer of ceramic fiber insulation known as "durablanket" and an outer layer of the material known as "duraback". The ceramic fibers are used in order to accommodate combustion chamber temperatures. The ceramic fiber insulation layer is also provided on the upper end face 21 and is indicated at 24. The whole of the combustion chamber is therefore defined by the inner face of the ceramic fiber layer and can accommodate very high temperatures of combustion. The combustion chamber is cylindrical with its axis vertical and is elongated in the vertical direction so as to accommodate substantially the whole of the combustion process and so that substantially the whole of the combustion chamber is taken up by the combustion process. Thus the burner and combustion air supply, described later are designed so that in the maximum combustion mode, the combustion process fills the combustion chamber but without any combustion continuing from the combustion chamber to the outlet duct.

The combustion gases escape from the combustion chamber by way of an outlet duct indicated generally at 25. The outlet duct 25 includes the flange 17 which connects to a short metal sleeve 26 extending from the flange through an opening formed in the wall 20. The short duct 26 is welded to the wall 20 so as to form a closure therewith. A layer 27 of the same insulating material is applied into the short duct 26 and beyond the short duct into a similar opening in the insulation material 22. In this way both the combustion chamber and the path of the gases exiting the combustion chamber is defined by the inner surface of the insulating material.

Surrounding the wall 20 is provided a further coaxially arranged sleeve 28 of a diameter slightly greater than that of a sleeve 20. This forms an air space between the sleeves. A yet further sleeve 29 is positioned coaxially around the outer surface of the sleeve 28 to form a further air space. The sleeve 29 forms an outer casing for the device. On one side, the casing closely surrounds the wall 28 defining an annular channel therebetween. On the other side adjacent the tank wall 10A the casing 29 defines two tangential wall portions 29A and 29B which extend directly to a position in contact with the tank wall. A flange 29C surrounds the rim of the wall 29 at its point of contact with the tank and a sealing strip 29D closes the space between the flange and the wall to enclose the air space defined between the wall 28, the tank and the wall 29. The outer surface of the wall 29 is covered by an insulating layer 29E.

Both of the air spaces communicate with an upper disc-shaped air space 30 between the end face 21 of the sleeve 20 and an upper end plate 31 which is welded to the end of the casing 29. In this way the outer surface of the sleeve 20 is enclosed by the further sleeves and the air spaces defined therebetween. As the casing 29 is closed at its upper end by the plate 31, the only position for entry of combustion air into the system is by way of the annular opening indicated at 32 at the lower end of the casing 29. On the outer side, the opening 32 is defined between the casing 29 and the outer surface of the sleeve 28. On other other side adjacent the tank 10, the opening 32 is defined in a bottom closure wall 32A.

Any such air entering the opening 32 thus will pass along the outer sleeve to the upper end of the outer sleeve at which it communicates with the inner annular air channel and also with the end space 30. Thus air flowing into the system is drawn from the air space 30 and from the outer annular channel into the inner annular channel for movement down the inner annular channel into a lower manifold indicated at 33. The upper surface of the end plate 31 is Covered by a further layer of insulating material indicated at 31A.

An annular connecting channel 34 is provided which communicates with the inner annular channel by way of a plurality of holes 35 through the wall 20. From the annular connecting channel, the air escapes into the manifold 33 by a plurality of openings 36 in a lower end plate 37. The lower end plate 37 forms an upper wall of the manifold 33 which also includes a peripheral cylindrical wall, a closed base 38 and a surrounding annular shield 39. The whole of the manifold including the base plate 37 can move away from the lower end of the combustion chamber by pivotal movement about a hinge 40 offset to one side of the device. The hinge 40 is provided between the plate 37 and a plate 41 welded to the lower edge of the sleeve 28 and projecting outwardly to one side thereof in a direction at 90° to the outlet duct.

The base plate 37 carries a burner 42 of a conventional construction. Thus the burner includes a jet nozzle 43 which supplies propane or other suitable combustion fuel from a pipe 44 in a jet form into the combustion chamber. The jet passes through a venturi 44 similarly mounted on the base plate 37 and arranged to draw air from the manifold 33 for entrainment with the gas jet for primary combustion. A plurality of secondary air openings 46 are provided around the burner 42 which enable air to be drawn from the manifold into the combustion chamber for passage along the inner surface of the combustion chamber to add combustion air into the combustion process within the chamber.

As stated above the primary air inlet defined by the venturi and also the secondary air inlet are designed relative to the jet nozzle 43 to provide the required amount of combustion products for the combustion to substantially fill but not overfill the combustion chamber in the maximum mode of combustion.

The pivotal movement of the manifold and base plate 37 is controlled by a latch schematically indicated at 47 which normally holds the manifold and base plate in the closed position for combustion. However when required, the base plate and manifold can be dropped away from the lower end of the combustion chamber to expose the burner for servicing and for ignition.

In operation with the device in an inoperative mode, the service person opens the manifold and baseplate by releasing the latch 47 to expose the burner. The opening action of the manifold and base plate allows any remaining combustible gases within the combustion chamber to fall out of the combustion chamber since these are generally heavier than air to reduce the possibility of explosion of these remaining gases on ignition. The service person then acts to turn on the gas supply from a suitable supply tank 48 and acts to ignite the flame at the burner 42 from a suitable heat source. With the burner thus observed to be in proper operation, the manifold and base plate are moved to the closed position so that the combustion commences within the combustion chamber.

As the combustion progresses, heat from the combustion engages against the inner surface of the insulating layer and commences to pass through the insulating layer toward the outer surface of the device. The combustion air is however drawn through the annular channels from the inlet 32 into the manifold thus carrying any heat which escapes from the outer surface of the sleeve 20 into the manifold for returning to the combustion process. In practice therefore while the combustion within the chamber is maximized by the most efficient use of the combustion air to generate a very high temperature, little or none of this heat within the combustion chamber is allowed to escape by the use of the insulation material together with the convoluted air channels which carry any remaining heat back to the manifold. In practice the outer surface of the device defined by the insulating layer 29E is cool to the touch while the temperature inside the combustion chamber can be very high. The temperature inside the casing 29 can reach 300° F. and the direct communication of air inside the casing onto the outer surface of the tank 10A provides additional heat exchange surface for communicating the heat to the tank.

As the combustion takes place wholly within the combustion chamber and is completed in that chamber, the shape of the flame is controlled by the shape of the combustion chamber and by the movement of the combustion gases to achieve most efficient combustion. The design of the injector nozzle, venturi and secondary air openings is arranged so that approximately 25 percent excess air is provided over theoretically perfect combustion and this amount of excess air is considered to be ideal for most efficient combustion. The combustion is thus complete at the upper end of the combustion chamber so that the heated combustion gases can escape from the outlet duct into the pipe 11 for heating of the oil tank or other equipment to which the device is attached.

A thermostat arrangement can be used to control the ga jet nozzle to reduce and increase the amount of gas. In practice the amount of gas injected is controlled between the preferred maximum amount in which the combustion substantially fills the combustion chamber to a reduced amount for reduced heat which is preferably of the order of one third of the maximum.

As the combustion chamber is substantially closed in the combustion position with the latch 47 holding the manifold and base plate in the closed position, any flashback condition which occurs is automatically suppressed by the fact that the flashback passes through the air channels before it can escape to the environment through the opening 32. As is well known, flashback is suppressed by passing the flame through a channel which acts to cool the flame by contact of the flame with metal parts. Generally flashback control is provided as an additional element which is applied to the equipment at an extra cost. In this case the flashback suppression is inherent in the design of the device with the channels thus providing the dual function of the flashback control and also the heat recovery aspect.

It will be noted that the combustion chamber is entirely free from heat transfer surfaces or medium so that the combustion is free to take place without any obstruction within the combustion chamber. The heat transfer effect thus occurs entirely downstream of the combustion heating device that is in the pipe 11 which is effectively separate from the combustion chamber and does not have any combustion within the pipe. The combustion is thus free to take place in the most efficient manner without any obstruction of the combustion gases. The air is drawn into the combustion process without inhibiting the flow of gases which could cause combustion to take place without the proper mix of gas and oxygen. The combustion takes place wholly within the specifically provided combustion chamber and hence corrosion of the pipe 11 by direction application of combusting gases thereon is avoided.

In an alternative arrangement (not shown) the air inlet channels are arranged on one side only of the chamber on that side remote from the storage tank to be heated. In this case, the housing is generally rectangular with one side adjacent the tank, two sides insulated and the fourth side having the air inlet channels.

Since various modifications can be made in my invention as hereinabove described, and many apparently widely different embodiments of same made within the spirit and scope of the claims without departing from such spirit and scope, it is intended that all matter contained in the accompanying specification shall be interpreted as illustrative only and not in a limiting sense.

I claim:

1. A combination of a tank and heating system therefor comprising a tank, a combustion heating apparatus mounted on one side of the tank exteriorly of the tank and comprising a gas burner for generating a stream of gas from a supply, means defining a substantially closed combustion chamber within which combustion of the stream of gas takes place, means for supplying combustion air for entrainment with the gas stream for combustion, means insulating the chamber so as to reduce escape of heat therefrom and an outlet duct arranged for extraction of the heated gases from the chamber, the combustion chamber comprising an elongate cylindrical body having sides, and upper end and a bottom end with an axis of the body arranged vertically, the burner being arranged at the bottom end of the cylindrical body and arranged to direct the stream of gas axially along he body, the outlet duct being arranged at the upper end of the chamber substantially at right angles to the chamber and a heat exchanging flue connected to said outlet duct and extending therefrom through the tank for transmitting heat from the combustion to the tank, the flue including an outlet exteriorly of the tank for discharging the combustion gas, means defining an air inlet channel means surrounding at least the sides of the combustion chamber and arranged such that said combustion air is drawn into the combustion chamber through said channel means, means mounting the combustion chamber on the tank so that one side of the combustion chamber lies along one side of the tank with the outlet duct extending therebetween, said mounting means including walls defining an enclosed space between the said side of the combustion chamber and said side of the tank through which space the outlet duct passes, said enclosed space forming one part of said air inlet channel means.

2. The combination according to claim 1 wherein the insulating means comprises a layer of an insulating material defining sides and an end face for the chamber.

3. The combination according to claim 1 wherein an inner surface of the combustion chamber is defined by a layer of a fibrous insulating material.

4. The combination according to claim 1 wherein an inner surface of the combustion chamber is defined by a layer of a fibrous insulating material wherein the fibrous insulating material comprises a mat of ceramic fibers.

5. The combination according to claim 1 wherein the combustion chamber within which the combustion is arranged to be fully completed consists of a sleeve defined by a layer of ceramic fibrous insulating material and an end face of ceramic fibrous insulating material, the combustion chamber being free from heat extraction means.

6. The combination according to claim 1 wherein the burner includes a met nozzle for defining a stream of the gas and a venturi surrounding the nozzle with one end of the venturi open to an air inlet manifold such that the stream acts to draw air through the venturi for entrainment with the stream and wherein there is provided air inlet opening means from the manifold around the burner for providing a stream of secondary combustion air for addition to the air entrained with the stream.

7. The combination according to claim 1 wherein the combustion chamber includes an end plate member pivotally mounted for movement away from the combustion chamber, the end plate member including an air manifold and carrying the burner together with a plurality of air openings for injection of combustion air from the manifold into the combustion chamber.

* * * * *